US008763415B2

(12) United States Patent
Jang et al.

(10) Patent No.: US 8,763,415 B2
(45) Date of Patent: Jul. 1, 2014

(54) AIR CONDITIONER WITH MULTI-LEVEL REFRIGERANT TUBE SUPPORT

(75) Inventors: Seok Hoon Jang, Gimhae-si (KR); Byoung Sup Kim, Gimhae-si (KR); Joon Hyuk Kwon, Changwon (KR); Woong Seok Noh, Namyangju-si (KR); Eun Seong Pack, Busan (KR)

(73) Assignee: LG Electronics Inc., Seoul (KR)

( * ) Notice: Subject to any disclaimer, the term of this patent is extended or adjusted under 35 U.S.C. 154(b) by 1282 days.

(21) Appl. No.: 12/081,402

(22) Filed: Apr. 15, 2008

(65) Prior Publication Data

US 2009/0107161 A1 Apr. 30, 2009

(30) Foreign Application Priority Data

Oct. 31, 2007 (KR) ..... 10-2007-0110631

(51) Int. Cl.
*F25D 19/00* (2006.01)

(52) U.S. Cl.
USPC ..... 62/298; 62/299

(58) Field of Classification Search
USPC ..... 62/298–299; 248/49, 51, 56, 65; 403/245–246; 29/521
See application file for complete search history.

(56) References Cited

U.S. PATENT DOCUMENTS

| | | | | |
|---|---|---|---|---|
| 2,542,442 | A * | 2/1951 | Weber | 248/68.1 |
| 3,719,986 | A * | 3/1973 | Ardolino | 29/509 |
| 6,203,366 | B1 * | 3/2001 | Muller et al. | 439/561 |
| 6,298,672 | B1 * | 10/2001 | Valicoff, Jr. | 62/62 |
| 2005/0076663 | A1 * | 4/2005 | Goodman | 62/298 |

FOREIGN PATENT DOCUMENTS

| | | | |
|---|---|---|---|
| AU | 2006309867 | A1 | 5/2007 |
| AU | 2006309884 | A1 | 5/2007 |
| CN | 1782551 | | 6/2006 |
| JP | 03-194334 | A | 8/1991 |
| JP | H03-107633 | | 11/1991 |
| JP | 2001-090995 | A | 3/2001 |
| KR | 1020040036137 | A | 4/2004 |
| KR | 100593080 | A | 7/2005 |
| KR | 1020050075143 | A | 7/2005 |
| WO | 2007/052539 | A1 | 5/2007 |
| WO | 2007/052556 | A1 | 5/2007 |

* cited by examiner

*Primary Examiner* — Cassey D Bauer
(74) *Attorney, Agent, or Firm* — McKenna Long & Aldridge LLP

(57) ABSTRACT

Provided is an air conditioner. The air conditioner includes an outdoor unit and an indoor unit, a plurality of refrigerant tubes guiding refrigerant to flow into the outdoor unit and the indoor unit, and a refrigerant tube support inside the outdoor unit, the refrigerant tube supporting the plurality of refrigerant tubes, wherein the refrigerant tube support has a height difference such that the plurality of refrigerant tubes are separately supported at different positions.

12 Claims, 6 Drawing Sheets

AIR CONDITIONER WITH MULTI-LEVEL REFRIGERANT TUBE SUPPORT

The present application claims priority to Korean Patent Application No. 10-2007-0110631, filed Oct. 31, 2007, which is hereby incorporated by reference in its entirety.

BACKGROUND

The present embodiments relate to an air conditioner in which a plurality of refrigerant tubes and service valves are supported by a support so that the plurality of refrigerant tubes and service valves are separately disposed at different positions over a base assembly of an outdoor unit.

In general, an air conditioner is a cooling/heating system that cools an indoor environment by continually performing a cycle of suctioning warm air from the indoor environment, performing heat exchange between the air and cold refrigerant, and expelling the cooled air back into the indoor environment. For heating, reverse conditions are employed to heat the indoor environment. The air conditioner performs sequential cycles using a compressor, condenser, expansion valve, and evaporator.

Such air conditioners may be divided largely into split system air conditioners with an outdoor unit and an indoor unit installed separately from each other, and integrated air conditioners with the outdoor unit integrally installed with the indoor unit.

A relatively recent phenomenon is the widespread use of multi unit air conditioners that are effectively applied in households wanting to install two or more air conditioners, and in buildings with multiple offices that respectively require an air conditioner. A multi unit air conditioner connects one outdoor unit to a plurality of indoor units to achieve the same effect as installing a plurality of split system air conditioners.

Such various types of air conditioners include a plurality of refrigerant tubes guiding refrigerant flowing between the outdoor unit and the indoor unit. Service valves individually installed on the refrigerant tubes are installed at positions adjacent to each other. Hence, interference is caused by the adjacent service valves when serving is performed through each of service valves.

SUMMARY

Embodiments provide an air conditioner in which refrigerant tube supports installed in an outdoor unit of the air conditioner are separately disposed at different positions to prevent interference between service valves separately disposed on ends of refrigerant tubes during after-service (A/S).

In one embodiment, an air conditioner includes: an outdoor unit and an indoor unit; a plurality of refrigerant tubes guiding refrigerant to flow into the outdoor unit and the indoor unit; and a refrigerant tube support inside the outdoor unit, the refrigerant tube supporting the plurality of refrigerant tubes, wherein the refrigerant tube support has a height difference such that the plurality of refrigerant tubes are separately supported at different positions.

In another embodiment, an air conditioner includes: a plurality of outdoor units and a plurality of indoor units; a plurality of refrigerant tubes guiding refrigerant to flow into the outdoor unit and the indoor unit; and a refrigerant tube support inside the outdoor unit, the refrigerant tube separately supporting the plurality of refrigerant tubes at different positions, wherein the refrigerant tubes comprise a liquid tube between the outdoor units and the indoor units, the liquid tube guiding liquid-phase refrigerant, a gas tube between the outdoor units and the indoor units, the gas tube guiding gas-phase refrigerant, and a high-low pressure common tube between the plurality of outdoor units, the high-low pressure common tube maintaining balance of refrigerant between the outdoor units.

In further another embodiment, an air conditioner includes: a plurality of refrigerant tubes guiding refrigerant flowing between an outdoor unit and an indoor unit; a left panel and a right panel defining exteriors of a left side and a right side of the outdoor unit, respectively; a base assembly defining a lower exterior of the outdoor unit, the base assembly including a base plate constituting a bottom surface and a leg supporting the base plate; a refrigerant tube support included in the base assembly, the refrigerant tube support separately supporting the plurality of refrigerant tubes at different positions, wherein the base plate comprises recesses receiving lower ends of the left panel and the right panel in edge portions thereof.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
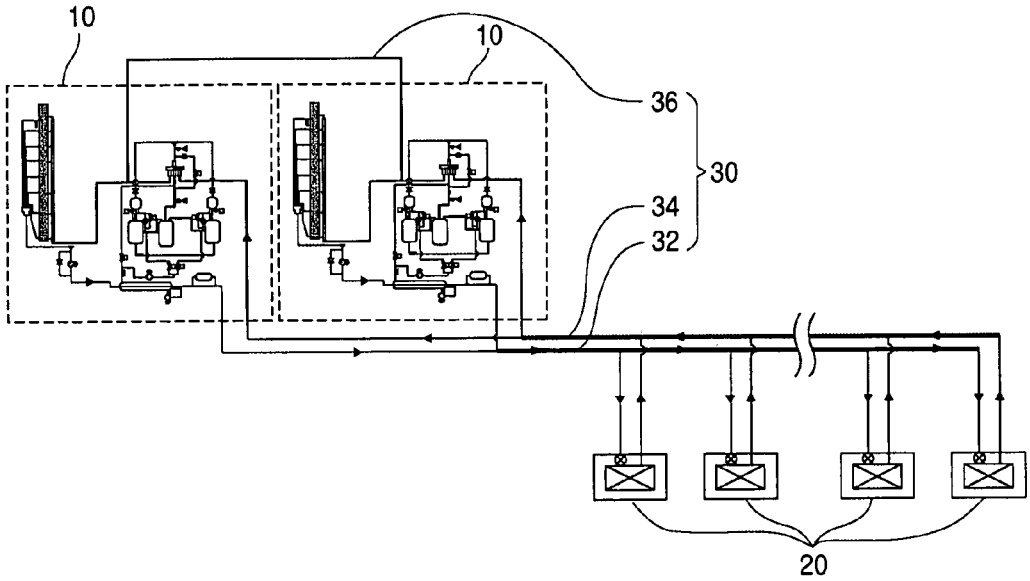
FIG. 1 is a block diagram of an air conditioner according to an embodiment.

FIG. 1 is a block diagram of an air conditioner according to an embodiment.

Referring to FIG. 1, an air conditioner includes a plurality of outdoor units 10 and a plurality of indoor units 20. The air conditioner may include a various number of outdoor units 10. However, the air conditioner including two outdoors units 10 will be described for convenience.

In addition, each of functions of the outdoor units 10 and the indoor units 20 are omitted herein because the functions are widely known functions.

Refrigerant is guided by a plurality of refrigerant tubes 30 to flow between the outdoor units 10 and the indoor units 20. The refrigerant tubes 30 include a liquid tube 32 in which liquid-phase refrigerant flows, a gas tube 34 in which gas-phase refrigerant flows, and a high-low pressure common tube 36 which is connected between two or more outdoor units 10 to maintain balance of refrigerant.

A plurality of outdoor units 10 are connected to the high-low pressure common tubes 36 so that inlets of heat exchangers communicate with each other to maintain the balance of the refrigerant between the outdoor units 10. The refrigerant flows into a heat exchanger of an unused outdoor unit 10 among the plurality of outdoor units 10, thereby improving heat exchange efficiency as a whole. High or low pressure refrigerant flows into the high-low pressure common tubes 36 according to a cooling mode or a heating mode of the air conditioner, respectively.

The liquid tube 32 and the gas tube 34 are separately divided such that the refrigerant flows into the outdoor units 10 and the indoor units 20. The divided liquid and gas tubes 32 and 43 may have different diameters according to capacities of the indoor units 20 connected thereto.

Figure 2:
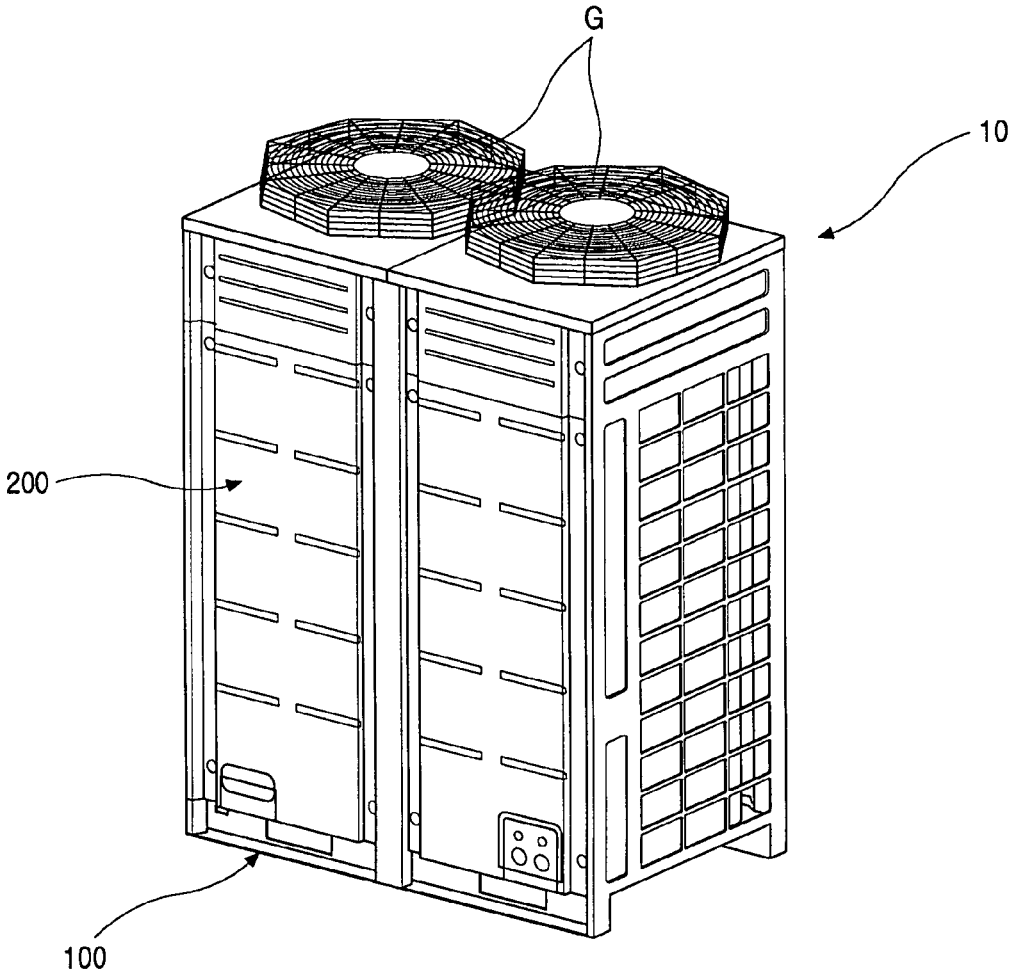
FIG. 2 is a perspective view illustrating an outdoor unit of an air conditioner according to an embodiment.

FIG. 2 is a perspective view illustrating an outdoor unit of an air conditioner according to an embodiment. Specifically, FIG. 2 exemplarily shows a type of outdoor unit for an air conditioner that discharges air upwards.

As illustrated in FIG. 2, an outdoor unit 10 has a hexahedral exterior shape and is connected to a plurality of indoor units 20 (not shown) through a liquid tube 32 and a gas tube 34. Refrigerant flows between the outdoor unit 10 and indoor units 20.

The outdoor unit 10 has its lower exterior defined by a base assembly 100, and includes a cabinet 200 provided above the base assembly 100 to form the remaining exterior thereof. Also, outlet grills G have an octagonal shape (when viewed from above) and protrude upward from the top of the cabinet 200 to discharge air upward through the outlet grills G.

Figure 3:
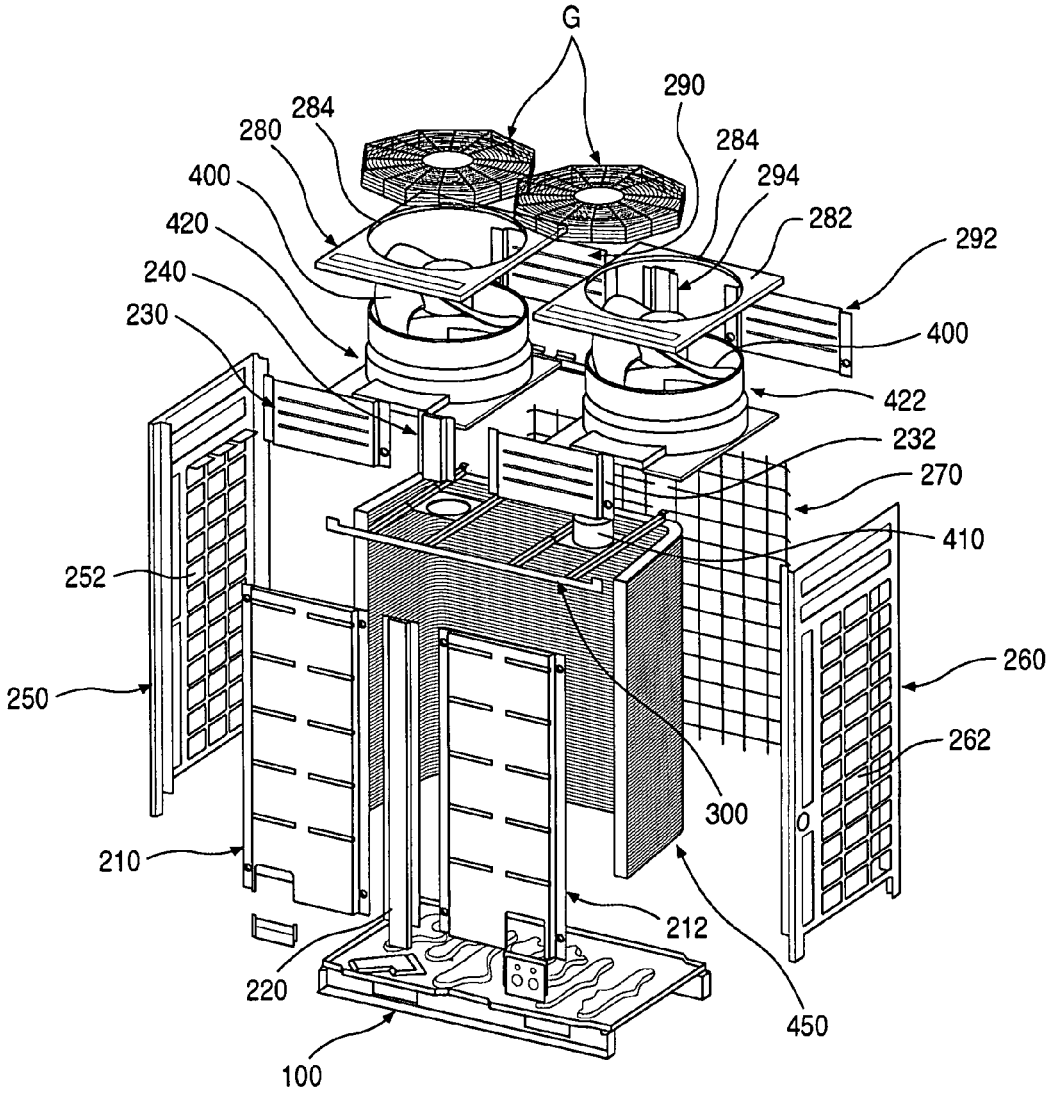
FIG. 3 is an exploded perspective view illustrating the outdoor unit of the air conditioner according to an embodiment.

FIG. 3 is an exploded perspective view illustrating the outdoor unit 10 of the air conditioner according to an embodiment.

As illustrated in FIG. 3, the cabinet 200 is formed with a plurality panels. In more detail, a pair of front panels 210 and 212 is provided at the front end of the base assembly 100 to define the front exterior of the outdoor unit. That is, a front left panel 210 and a front right panel 212 which have shapes of rectangular flat plates, are provided as a pair installed on the left and right, and a front center frame 220 is vertically elongated between the front left panel 210 and the front right panel 212.

A pair of front upper panels 230 and 232 is further provided above the pair of front panels 210 and 212. The front upper panels 230 and 232 form the front upper exterior of the outdoor unit, and include a front upper left panel 230 and a front upper right panel 232 at the left and right, respectively. A front upper frame 240 is further provided between the front upper left panel 230 and the front upper right panel 232. The front upper frame 240 is shaped correspondingly to the front center frame 220, and supports the pair of front upper panels 230 and 232.

A left panel 250 and a right panel 260 are provided at the left and right ends, respectively, of the base assembly 100, defining the left and right external facets of the outdoor unit. Also, a left grill 252 is integrally formed with the left panel 250, and a right grill 262 is integrally formed with the left panel 260. Thus, outside air is able to enter the outdoor unit 10 through left grill 252 and the right grill 262.

A pair of rear grills 270 is provided at the upper rear end of the base assembly 100. The rear grills 270 define the rear exterior surface, and air enters the outdoor unit 10 from the rear thereof through the rear grills 270.

A rear center frame (not shown) is further provided at the central portion of the pair of rear grills 270 opposite the front center frame 220 to support the pair of rear grills 270.

A pair of top panels 280 and 282 is provided between the top ends of the left panel 250 and the right panel 260 to define the top exterior of the outdoor unit. That is, the external top surface of the outdoor unit 10 is defined by the rectangular left top panel 280 and right top panel 282. Each of outlets 284 is defined vertically through each of the pair of top panels 280 and 282.

Also, the outlet grills (G) are installed on the outlets 284. The outlet grills (G) prevent impurities from the outside from entering through the outlets 284, and also allow air inside to be discharged upwards.

A pair of rear upper panels 290 and 292 is further provided at the top of the pair of rear grills 270. The rear upper panels 290 and 292 define the rear upper exterior of the outdoor unit, and are formed to correspond in shape to the front upper panels 230 and 232.

Accordingly, the rear upper panels 290 and 292 include a rear upper left panel 290 and a rear upper right panel 292 at the left and right sides, and a rear upper frame 294 is further provided between the rear upper left panel 290 and the rear upper right panel 292. The rear upper frame 294 is formed in a shape corresponding to the front upper frame 240, and supports the pair of rear upper panels 290 and 292.

A frame assembly 300 is provided within the cabinet 200. The frame assembly 300 is for supporting shrouds 420 and 422 a blower fan 400, and other components (to be described below), and is installed on the top ends of the front panels 210 and 212.

A pair of blower fan 400 and fan motor 410 assemblies is installed at the top of the frame assembly 300. The pair of blower fans 400 is enclosed by a pair of shrouds 420 and 422. That is, a left shroud 420 and a right shroud 422 having the same shape are installed at the top of the frame assembly 300, and a blower fan 400 is disposed to the inside of the pair of shrouds 420 and 422.

A heat exchanger 450 is installed within the cavity 200. The heat exchanger 450 exchanges heat between refrigerant flowing therein and air from the outside, and is installed on the upper left end, rear end, and right end of the base assembly 100. That is, the heat exchanger 450 is formed in a '∩' shape as shown (when viewed from above).

Figure 4:
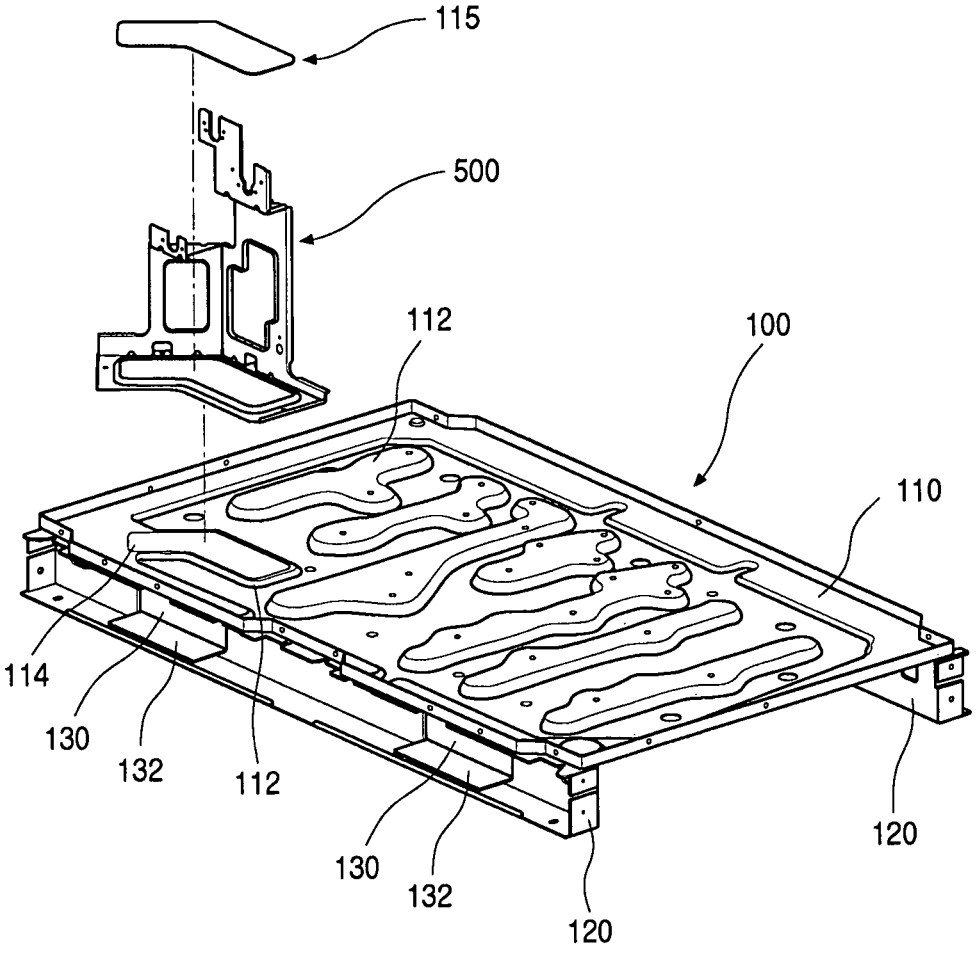
FIG. 4 is a perspective view illustrating a base assembly of an outdoor unit of an air conditioner according to an embodiment.

FIG. 4 is a perspective view illustrating a base assembly 100 of an outdoor unit of an air conditioner according to an embodiment.

Referring to FIG. 4, the base assembly 100 includes a base plate 110 constituting a bottom surface and legs 120 supporting the base plate 110.

The base plate 110 has a rectangular shape, and the lags 120 are longitudinally disposed in left and right directions on lower sides of front and rear ends of the base plate 110 having the rectangle shape.

The base plate 110 is formed in a rectangular plate shape. Recesses receiving lower ends of a left panel 250 and a right panel 260 are formed in edge portions of the base plate 110, respectively.

The base assembly 100 includes a plurality of forming portions 112.

In more detail, predetermined portions of a middle portion of the base plate 110, as illustrated in FIG. 4, is depressed in a downward direction. The plurality of forming portions 112 are protruded in an upward direction inside the base plate 110.

The legs 120 are disposed on the lower sides of the front and rear ends of the base plate 110. Each of the legs 120 has a "□" shape in a sectional view. Top surfaces of the legs 120 are in contact with the base plate 110, and bottom surfaces of the legs 120 are in contact with a bottom surface of a building.

A plurality of forklift holes 130 pass through the legs 120. The forklift holes 130 are holes in which a fork of a forklift passes therethrough. Thus, the forklift holes 130 have a distance adapted to receive the fork of the forklift. Preferably, the forklift holes 130 have a rectangular shape.

Guide members 132 are protruded in a front direction from lower ends of the forklift holes 130. The guide members 132 guide the fork of the forklift to smoothly insert the fork of the forklift into the forklift holes 130. The guide member 110 is formed in a rectangular plate shape, and a portion of the guide member 110 is protruded in the front direction.

A refrigerant tube support 500 supporting a plurality of refrigerant tubes 30 is fixedly disposed on the base assembly 100. The refrigerant tube support 500 is disposed on at least one of the plurality of forming portions 112 described above. As described above, the refrigerate tube support 500 is disposed on the forming portion 112 disposed in a left front end portion of the base plate 110.

In detail, a lower portion of the refrigerant tube support 500 surrounds an edge of one forming portion 112 of the plurality of forming portions 112 protruded in the upward direction. A tube withdrawal hole 114 vertically passes through the forming portion 112 on which the refrigerant tube support 500 is disposed. The plurality of refrigerant tubes 30 pass through the tube withdrawal hole 114.

A tube withdrawal cover 115 selectively shields the tube withdrawal hole 114. A shape of the tube withdrawal cover 115 corresponds to that of the tube withdrawal hole 114. The tube withdrawal hole 114 is shielded by the tube withdrawal cover 115 when the final product of the air conditioner is released. In case where the refrigerant tubes 30 need to pass through the tube withdrawal hole 114, the tube withdrawal cover can be removable.

Figure 5:
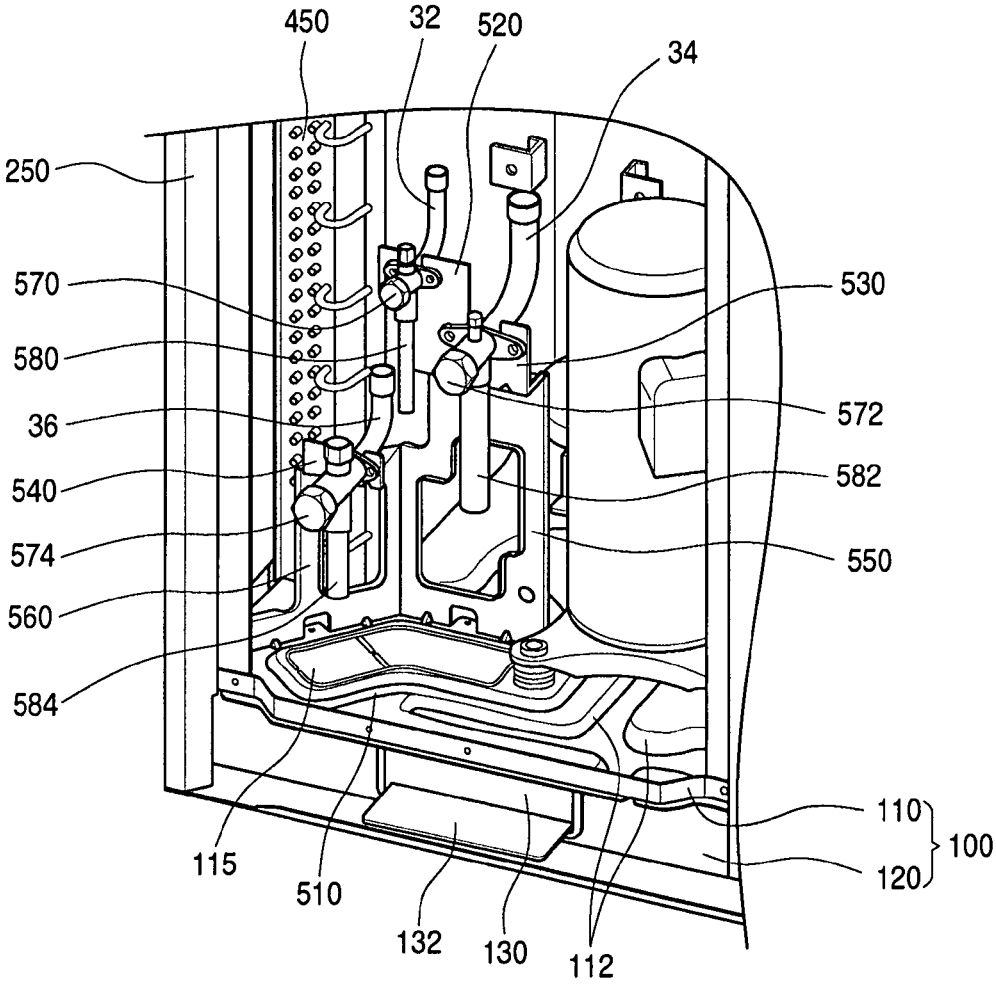
FIG. 5 is a partial perspective view illustrating an outdoor unit of an air conditioner with a refrigerant tube support installed according to an embodiment.
Figure 6:
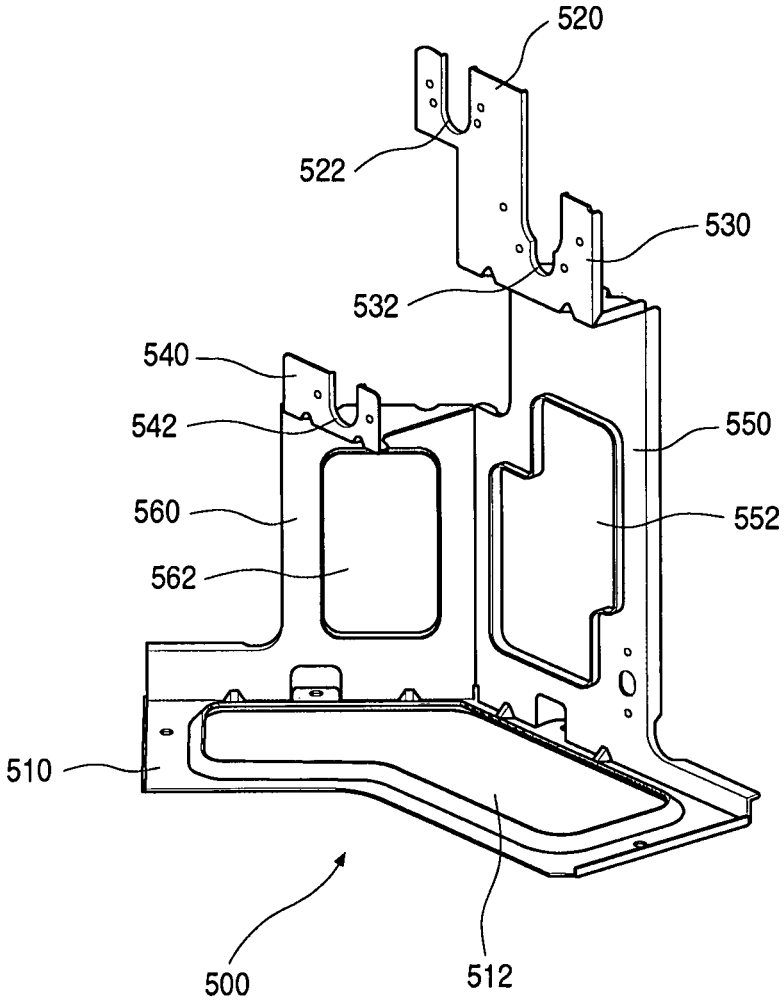
FIG. 6 is a perspective view of a refrigerant tube support according to an embodiment.

FIG. 5 is a partial perspective view illustrating an outdoor unit of an air conditioner with a refrigerant tube support 500 installed on a base assembly 100, and FIG. 6 is a perspective view of the refrigerant tube support 500.

Hereinafter, a constitution of the refrigerant tube support 500 will be described in detail with reference to FIGS. 4 to 6.

Referring to FIGS. 4 to 6, the refrigerant tube support 500 has a height difference such that the plurality of refrigerant tubes 30 are supported at various different positions. As described above, the lower portion of the refrigerant tube support 500 surrounds the edge of the forming portion 112 disposed in the left front end portion of the base plate 110 among the plurality of forming portions 112.

The refrigerant tube support 500 includes a bottom plate 510, a liquid tube support 520, a gas tube support 530, a common tube support 540, a first supporting plate 550, and a second supporting plate 560. The bottom plate 510 is in contact with the base assembly 100. The liquid tube support 520 supports the liquid tube 32 spaced from the bottom plate 510. The gas tube support 530 supports a gas tube 34 spaced from the bottom plate 510. The common tube support 540 supports a high-low pressure common tube 36 spaced from the bottom plate 510. The first supporting plate 550 is bent and extends from the bottom plate 510 in an upward direction to support the liquid tube support 520 and the gas tube support 530. The second supporting plate 560 is bent and extends from the bottom plate 510 in an upward direction to support the common tube support 540.

The liquid tube support 520, the gas tube support 530, and the common tube support 540 are different in installation height. In addition, the common tube support 540 is disposed in a front direction of the liquid tube support 520 and the gas tube support 530. Since the liquid tube support 520, the gas tube support 530, and the common tube support 540 are different in installation height, a welding process for installing each of the refrigerant tubes 30 can be easily performed and interference caused by adjacent service valves can be prevented.

In detail, the bottom plate 510 of the refrigerant tube support 500 has a ">" shape in a plan view. The shape of the bottom plate 510 corresponds to that of the forming portion 112 disposed in the left front end portion of the base plate 110. A tube hole 512 vertically passes through the bottom plate 510. A size and shape of the tube hole 512 correspond to those of the tube withdrawal hole 114. Preferably, the tube withdrawal cover 115 vertically passes through the tube hole 512.

The first supporting plate 550 and the second supporting plate 560 extend from a rear end of the bottom plate 510 in an upward direction. The first supporting plate 550 is vertically disposed on a right rear end of the bottom plate 510 in the upward direction such that the first supporting plate 550 is perpendicular to the bottom plate 510. The second supporting plate 560 is vertically disposed on a left rear end of the bottom plate 550 in the upward direction.

The first supporting plate 550 is connected to the second supporting plate 560. The first supporting plate 550 has a height higher than that of the second supporting plate 560.

The gas tube support 530 and the liquid tube support 520 are disposed on an upper portion of the first supporting plate 550 in one body. An upper end of the first supporting plate 550 is perpendicularly bent in a front direction, and then again bent in the upward direction. The gas tube support 530 and the liquid tube support 520 are disposed on the bent portion in one body.

Thus, the gas tube support 530 and the liquid tube support 520 are protruded from the first supporting plate 550 in the front direction by a predetermined distance. As described above, the liquid tube support 520 has a height relatively higher than that of the gas tube support 530.

A gas tube recess 532 and a liquid tube recess 522, which have semicircular recess shapes, are disposed on upper ends of the gas tube support 530 and the liquid tube support 520, respectively. The gas tube 34 and the liquid tube 32 are received in the gas tube recess and the liquid tube recess 522, respectively. Preferably, the gas tube recess 532 and a liquid tube recess 522 having semicircular shapes have diameters corresponding to external diameters of the gas tube 34 and the liquid tube 32.

An upper end of the second supporting plate 560 is perpendicularly bent in the front direction, and then again bent in the upward direction to form the common tube support 540. Thus, the common tube support 540 is protruded from the second supporting plate 560 in the front direction by a predetermined distance. A common tube recess 542 receiving the high-low pressure common tube 36 is disposed on an upper end of the common tube support 540.

The insides of the first and second supporting plates 550 and 560 are cut to form holes. A first hole 552 having a predetermined size passes through the inside of the first supporting plate 550 in front and rear directions. A second hole 562 having a predetermined size passes through the inside of the second supporting plate 560 in the front and rear directions. Since the holes are formed inside the first and second supporting plates 550 and 560, interference is prevented during installation, servicing, and maintenance and material reduction is achieved.

The plurality of refrigerant tubes 30 include service valves 570, 572, and 574 for serving, respectively. That is, the liquid tube 32 includes the liquid tube service valve 570, the gas tube 34 includes the gas tube service valve 572, and the high-low pressure common tube 36 includes the common tube service valve 574. A liquid tube connector 580 is connected to a lower side of the liquid tube service valve 570, a gas tube connector 582 is connected to a lower side of the gas tube service valve 572, and a common tube connector 584 is connected to a lower side of the common tube service valve 574.

Tubes connected to the liquid tube connector 580, the gas tube connector 582, and the common tube connector 584, respectively, to extend in downward direction pass through the tube withdrawal hole 114 of the base assembly 100.

Therefore, the service valves 570, 572, and 574 and the refrigerant tubes 30 are separately supported by the refrigerant tube support 500 on different positions over the base assembly 100.

In the air conditioner according to the present disclose, the refrigerant tube support supporting the refrigerant tubes is fixedly installed on the base assembly of the outdoor unit. The refrigerant tubes are separately supported by the refrigerant tube support at the different positions. Therefore, the interference caused by adjacent refrigerant tubes is prevented when each of the refrigerant tubes is connected to the outdoor unit and the indoor unit. In addition, the refrigerant valves supported by the refrigerant tube supports are separately disposed at different positions to prevent the interference caused by adjacent service valves during after-service (A/S). Therefore, the installation, the servicing, and the maintenance can be easily performed.

Since the refrigerant tube supports supporting the refrigerant tubes are disposed over the tube withdrawal hole passing through the base assembly, the refrigerant tubes supported by the refrigerant tube supports and connected to the indoor unit can be installed below the refrigerant tube supports.

While the present disclose has been particularly shown and described with reference to exemplary embodiments thereof, it will be understood by those of ordinary skill in the art that various changes in form and details may be made therein without departing from the spirit and scope of the present disclose as defined by the following claims.

What is claimed is:

1. An air conditioner, comprising:

an outdoor unit and an indoor unit;

a plurality of refrigerant tubes guiding refrigerant to flow into the outdoor unit and the indoor unit; and a refrigerant tube support inside the outdoor unit, the refrigerant tube support supporting the plurality of refrigerant tubes, wherein the refrigerant tube support comprises a liquid tube support, a gas tube support and a common tube support, each support comprising a recess for receiving corresponding tube, wherein the liquid tube support, the gas tube support, and the common tube support are configured to be at different heights relative to one another, and wherein the refrigerant tube support comprises:

a bottom plate;

a first supporting plate upwardly bent and extending from the bottom plate, the first supporting plate at an upper end being formed with the liquid tube support and the gas tube support; and a second supporting plate upwardly bent and extending from the bottom plate, the second supporting plate at an upper end being formed with the common tube support, wherein the first supporting plate is in contact with the second supporting plate and the first supporting plate and the second supporting plate are configured to be at different heights each other.

2. The air conditioner according to claim 1, wherein the refrigerant tube support is fixed to a base assembly defining a lower exterior of the outdoor unit.

3. The air conditioner according to claim 2, wherein the base assembly comprises a plurality of forming portions protruded upwardly, and a lower end of the refrigerant tube support surrounds at least one of the plurality of forming portions.

4. The air conditioner according to claim 3, wherein at least one of forming portions of the base assembly comprises a tube withdrawal hole through which the plurality of refrigerant tubes passes.

5. The air conditioner according to claim 4, wherein the tube withdrawal hole is selectively shielded by a tube withdrawal cover.

6. An air conditioner, comprising:

a plurality of outdoor units and a plurality of indoor units;

a plurality of refrigerant tubes guiding refrigerant to flow into the outdoor unit and the indoor unit; and a refrigerant tube support inside one of the outdoor units, the refrigerant tube support separately supporting the plurality of refrigerant tubes at different positions, wherein the refrigerant tubes comprise a liquid tube between the outdoor units and the indoor units, a gas tube between the outdoor units and the indoor units, and a high-low pressure common tube between the plurality of outdoor units, wherein the liquid tube guides liquid-phase refrigerant, the gas tube guides gas-phase refrigerant, and the high-low pressure common tube maintains balance of refrigerant between the outdoor units, wherein the refrigerant tube support comprises:

a bottom plate including a first forming portion;

a supporting plate upwardly bent and extending from the bottom plate, wherein the supporting plate is provided with a liquid tube support, a gas tube support, and a common tube support, wherein the refrigerant tube support is fixed to a base assembly defining a lower exterior of the outdoor unit, and wherein the first forming portion is provided with a hole, and the base assembly comprises a plurality of second forming portions protruded upwardly, and the first forming portion of the bottom plate surrounds at least one of the plurality of second forming portions.

7. The air conditioner according to claim 6, wherein the supporting plate comprises a first supporting plate bent and extending from the bottom plate in an upward direction, wherein the first supporting plate is provided with the liquid tube support and the gas tube support; and a second supporting plate bent and extending from the bottom plate in the upward direction, wherein the second supporting plate is provided with the common tube support.

8. The air conditioner according to claim 6, wherein the common tube support is located at a front side of the liquid tube support and the gas tube support.

9. The air conditioner according to claim 7, wherein insides of the first supporting plate and the second supporting plate are cut to form holes.

10. An air conditioner, comprising:

a plurality of refrigerant tubes guiding refrigerant flowing between an outdoor unit and an indoor unit;

a left panel and a right panel defining exteriors of a left side and a right side of the outdoor unit, respectively;

a base assembly defining a lower exterior of the outdoor unit, the base assembly including a base plate constituting a bottom surface and a leg supporting the base plate;

wherein the base plate comprises recesses receiving lower ends of the left panel and the right panel in edge portions thereof;

a refrigerant tube support included in the base assembly, the refrigerant tube support separately supporting the plurality of refrigerant tubes at different positions, wherein the refrigerant tube support comprises:

a bottom plate in contact with the base assembly;

a first supporting plate upwardly bent and extending from the bottom plate, the first supporting plate at an upper end being formed with a liquid tube support and a gas tube support; and a second supporting plate upwardly bent and extending from the bottom plate, the second supporting plate an upper end being formed with a common tube support, wherein the first supporting plate is in contact with the second supporting plate and the first supporting plate and the second supporting plate are configured to be at different heights each other, and wherein the liquid tube support, the gas tube support, and the common tube support are configured to be at different heights one another.

11. The air conditioner according to claim 10, wherein the leg comprises a plurality of forklift holes through which a fork of a forklift passes.

12. The air conditioner according to claim 11, wherein the leg further comprises a guide member protruded from a lower end of the forklift hole, the guide member guiding the fork of the forklift to smoothly insert the fork of the forklift into the forklift holes.

* * * * *